US009585457B2

(12) United States Patent
Simard et al.

(10) Patent No.: US 9,585,457 B2
(45) Date of Patent: Mar. 7, 2017

(54) FUNCTIONAL DYNAMIC COSMETIC PACKAGE

(71) Applicant: Avon Products, Inc., Suffern, NY (US)

(72) Inventors: Marisol Simard, Upper Nyack, NY (US); Gregory A. Ornoski, Teaneck, NJ (US)

(73) Assignee: AVON PRODUCTS, INC., Rye, NY (US)

( * ) Notice: Subject to any disclaimer, the term of this patent is extended or adjusted under 35 U.S.C. 154(b) by 169 days.

(21) Appl. No.: 14/488,776

(22) Filed: Sep. 17, 2014

(65) Prior Publication Data

US 2015/0003889 A1 Jan. 1, 2015

Related U.S. Application Data

(63) Continuation of application No. 13/279,518, filed on Oct. 24, 2011, now abandoned.

(51) Int. Cl.

| | |
|---|---|
| ***A45D 34/04*** | (2006.01) |
| ***A45D 40/26*** | (2006.01) |
| ***A45D 33/02*** | (2006.01) |

(52) U.S. Cl.

CPC ..... *A45D 34/046* (2013.01); *A45D 33/02* (2013.01); *A45D 34/048* (2013.01); *A45D 40/267* (2013.01); *A46B 2200/1053* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 3,298,054 | A * | 1/1967 | Humble | A45D 34/045 401/122 |
| 4,403,624 | A | 9/1983 | Montgomery | |
| 4,407,311 | A | 10/1983 | Gueret | |
| 4,929,108 | A * | 5/1990 | Gueret | A45D 40/267 401/122 |
| 5,061,103 | A | 10/1991 | Walsh-Smith | |
| 5,074,693 | A | 12/1991 | Iisuka et al. | |
| 5,172,992 | A * | 12/1992 | Ackermann | A45D 34/048 401/129 |
| 5,700,100 | A | 12/1997 | Ackermann | |
| 5,875,791 | A | 3/1999 | Sheffler et al. | |
| 6,026,823 | A * | 2/2000 | Gueret | A45D 34/045 132/218 |
| 6,261,017 | B1 | 7/2001 | Gueret | |
| 7,223,035 | B1 | 5/2007 | Engel et al. | |
| 8,206,049 | B2 * | 6/2012 | Thiebaut | A45D 34/046 401/121 |
| 2009/0317171 | A1 | 12/2009 | Thiebaut | |

* cited by examiner

*Primary Examiner* — David Walczak
(74) *Attorney, Agent, or Firm* — Jonathan D. Ball; Greenberg Traurig, LLP

(57) ABSTRACT

Packages for cosmetics are provided including an applicator that engages with a wiper component of a container in a manner such that the applicator and wiper are capable of moving together in one or more directions within the container, including without limitation, vertically, horizontally, diagonally, rotationally, and any combination of such movements. This increased range of mobility permits the applicator element to access more of the cosmetic material within the container than heretofore possible.

12 Claims, 7 Drawing Sheets

FIG. 3
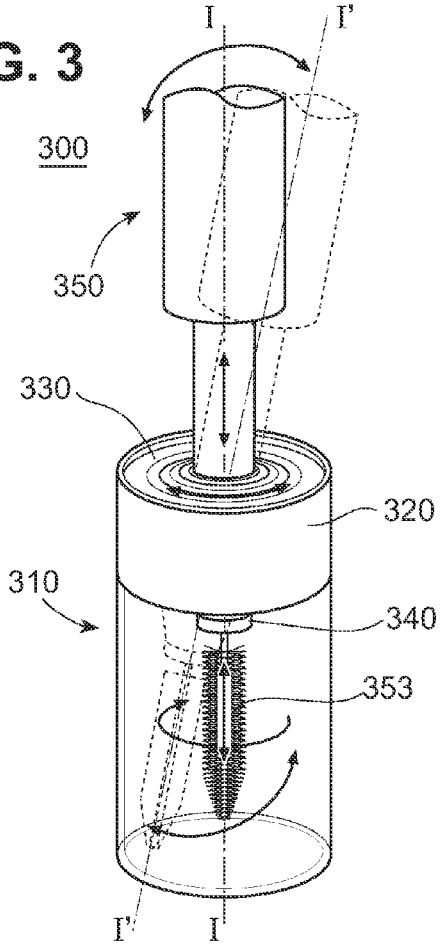
FIG. 3A
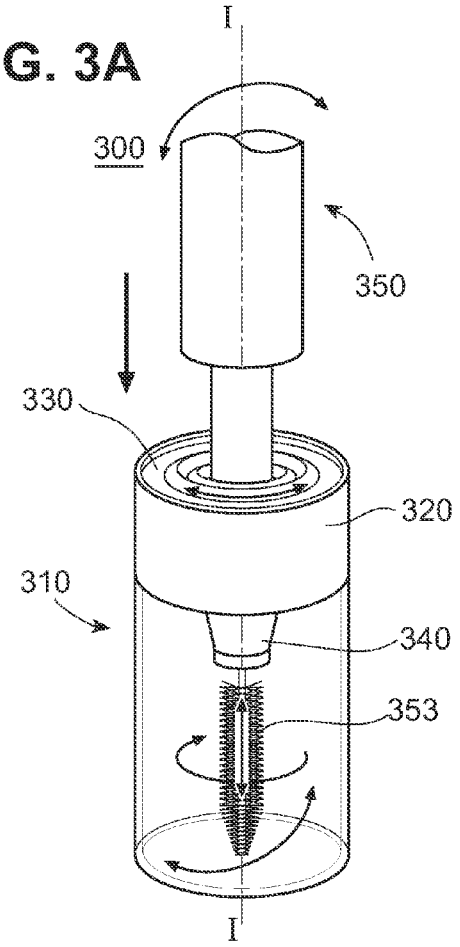
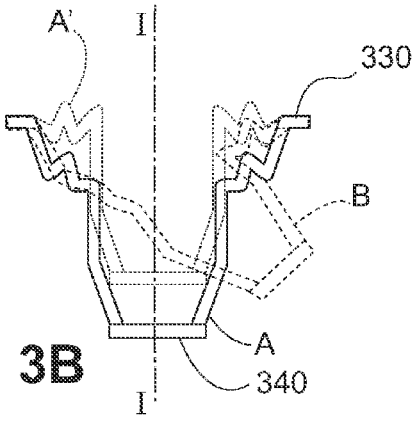
FIG. 3B
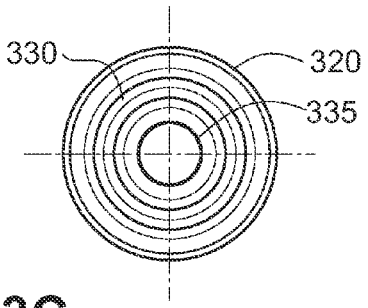
FIG. 3C

FIG. 4
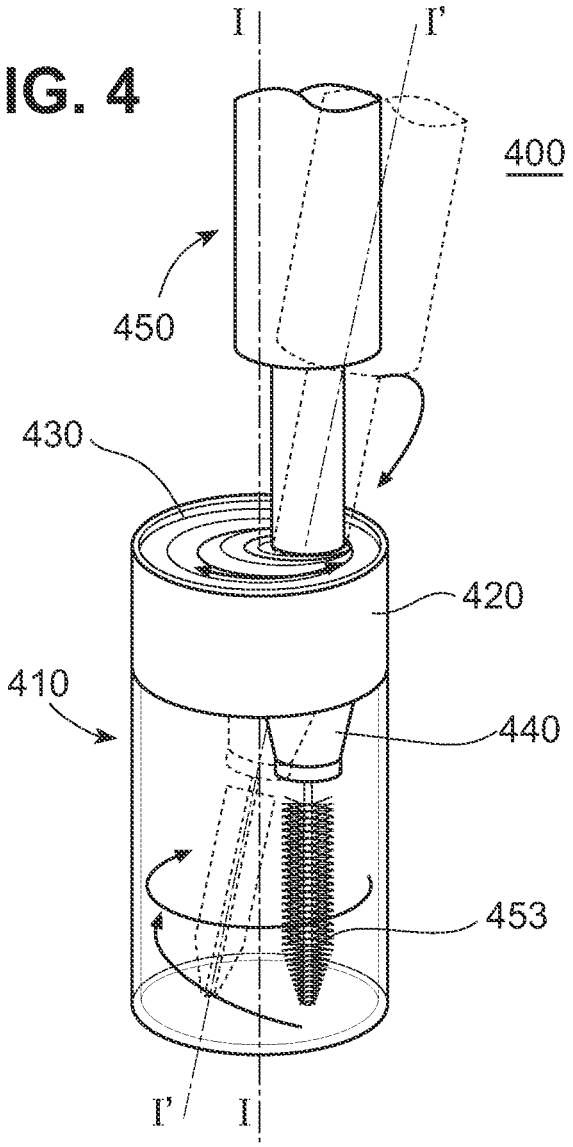
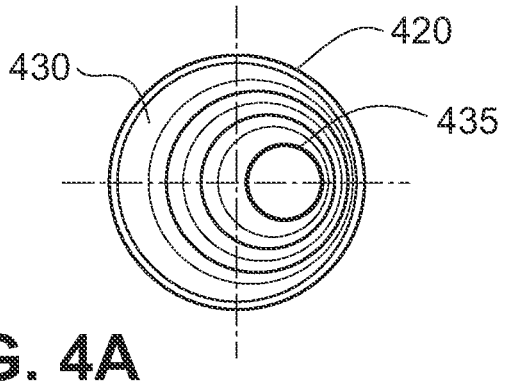
FIG. 4A

FUNCTIONAL DYNAMIC COSMETIC PACKAGE

CROSS-REFERENCE TO RELATED APPLICATIONS

This application is a continuation of, and claims priority t, U.S. patent application Ser. No. 13/279,518, filed Oct. 24, 2011, now abandoned, the entirety of which is herein incorporated by reference for all purposes.

FIELD OF THE INVENTION

The present application generally relates to packaging for cosmetic products, such as mascara, which comprises a container for holding a cosmetic composition and an applicator which is disposed through an opening in the container such that a portion of the applicator is brought into contact with the cosmetic composition. As the applicator is removed from the container, a wiper removes excess cosmetic composition from the applicator. The wiper of the present invention is dynamic rather than static with respect to the container, thus allowing for an improved range of movement of the applicator element within the interior of the container so that the amount of cosmetic product that can be recovered and transferred to the applicator is increased, as explained in more detail below.

BACKGROUND

Conventional mascara packaging consists of a cylindrical container that contains a supply of mascara, the container having a threaded neck to which a cap and rod applicator assembly is reversibly secured by complementary threading on the cap. The rod is inserted into the container through a wiper prior to closing the cap and, as the user screws the cap onto the container, the rod only moves a short distance (i.e., the height of the threaded area) further into the container. When the user unscrews the cap and withdraws the rod, the wiper scrapes or removes excess cosmetic from the applicator element to provide a more uniform, metered dose of mascara on the applicator. The wiper conventionally consists of an annular constriction of rubber or plastic in or near the neck of the container. Such mascara applicators and packaging are disclosed, for example, in U.S. Pat. No. 4,403,624 to Montgomery and U.S. Pat. No. 5,061,103 to Walsh-Smith, to name just a few.

A drawback to the conventional design is that the rod is axially centered in the container through a static wiper element and, therefore, the applicator element is not able to come into contact with mascara coating the interior surfaces of the container. Consequently, much of the inaccessible product is wasted and may wind up hardening inside the container, in particular proximate to the base of the container, especially any vertices thereof.

One attempt to solve this problem is disclosed in U.S. Pat. Nos. 5,700,100 and 5,172,992, both to Ackermann, which relate to a mascara packaging having a stirring element that scrapes mascara from the edges of the container when the cap is screwed on or off. Likewise, U.S. Pat. No. 5,074,693 to Iizuka et al. also describes a stirrer in conjunction with a mascara application for the purpose of scraping viscous cosmetic liquids from the inner surface of the container.

Another approach for bringing more of the liquid cosmetic disposed in the container into contact with the applicator has involved the provision of a flexible container which may be squeezed by the user to force the composition on to the applicator. Such a device is described in U.S. Pat. No. 7,223,035 to Engel et al.

There is a continuing need in the art for improved functional designs for cosmetic applicators which overcome one or more of the deficiencies of the conventional applicators. It is therefore an object of the invention to provide cosmetic applicators which provide for a greater range of movement of the applicator within the interior of the container. In particular, it is an object of the invention to provide dynamic wipers, which, when engaged with the applicator, permit the applicator element to be moved within the interior of the container with greater range than previously attainable.

SUMMARY OF THE INVENTION

In accordance with the foregoing objectives and others, the present invention provides packages for cosmetics having an applicator which engages with a wiper component in a manner such that the applicator and wiper are capable of moving together in one or more directions within the container, including without limitation, vertically, horizontally, diagonally, rotationally, and any combination of such movements. This increased range of mobility permits the applicator element to access more of the cosmetic material within the container than heretofore possible.

The invention provides a new package for a liquid or solid composition (e.g., a mascara, eye shadow, or other cosmetic), the package comprising (i) a container for holding said composition, (ii) an applicator for removing a portion of the composition from the container and transferring it to a surface, the applicator comprising a handle for gripping on one end thereof and an applicator element for holding a charge of said composition on the other end thereof; and (iii) a wiper having an orifice forming a passage between the exterior and interior of said container. The applicator is disposed through the wiper orifice such that a portion of the applicator is brought into contact with the composition. The orifice of the wiper is generally complementary in shape to the cross-sectional shape of the applicator so that it can remove excess composition from the applicator element when the applicator element is drawn through the orifice upon removing the applicator from the container. The applicator engages with the wiper to form an assembly such that the applicator and wiper together are movable with one or more degrees of freedom with respect to said container.

For example, the applicator and wiper together may be capable of rotating about an axis defined by said applicator, or moving in a circle about the central axis. The applicator and wiper may also together be capable of tilting about an axis defined by said applicator, or moving along an axis defined by said applicator (i.e., toward and away from the interior of said container), or moving perpendicular to an axis defined by said applicator (e.g., laterally across the width of the container).

The wiper may be attached to an opening in the container through an elastic or a telescoping membrane so that the wiper is freely moveable in one, two, or three dimensions with respect to the container. By virtue of the improved range of movement of the applicator/wiper assembly, the applicator element is capable of reaching areas in the interior of the container that are inaccessible with static wiper designs, including the interior surfaces of the container. This is particularly advantageous where the composition is pseudoplastic, having a high initial viscosity in the absence of shear, because the applicator element can recover liquid adhered to the inner walls of the container which would otherwise be wasted or accessible perhaps only with vigorous shaking of the container. The dynamic wiper arrangement of the invention is also contemplated to find application with generally flat or planar shaped applicators, in which case the applicator element will typically have an oblong shaped cross-section and the wiper orifice will have a complementary oblong shape.

These and other aspects of the invention will be better understood by reading the following detailed description and appended claims.

BRIEF DESCRIPTION OF THE DRAWINGS

The preferred embodiments of the present invention are illustrated by way of example and are not limited to the following figures:

FIG. 3 illustrates an exemplary package for dispensing a material according to the invention comprising a rotating, flexible wiper support having an orifice through its geometric center, such that the wiper and applicator together are capable of rotating about the axis I-I defined by said applicator, moving up and down, and toggling;

FIG. 3A illustrates an exemplary package for dispensing a material according to the invention comprising a rotating, telescoping wiper support having an applicator pressed downward toward a container through an orifice located at the geometric center of the wiper support;

FIG. 3B illustrates three positions of an exemplary telescoping wiper support 330, which may be a separate component, or may be integral with wiper element 340;

FIG. 3C is a top view of an exemplary, flexible, rotating wiper support 330 held in place by a mount 320 and comprising an orifice 335 through its geometric center;

FIG. 4 illustrates an exemplary package for dispensing a material according to the invention comprising a rotating, flexible wiper support having an orifice therethrough located away from its geometric center;

FIG. 4A is a top view of an exemplary, rotating wiper support 430 held in place by a mount 420 and comprising an orifice 435 located away from its geometric center;

DETAILED DESCRIPTION

All terms used herein are intended to have their ordinary meaning in the art unless otherwise provided.

The material to be dispensed is not particularly limited and include paints, cosmetics, and adhesives, to name a few, and may be in the form of solids (e.g., powders), suspensions, emulsions, liquids, and the like. As used herein, the term liquid is intended to include very viscous materials, including non-Newtonian liquids having very high initial viscosities, as well as gels and other materials capable of being dispensed from a container onto an applicator. Particular mention may be made of cosmetics, including, without limitation, mascara, foundation, lip gloss, lip colors, hair colors, hair styling formulations, nail polishes, and the like. The viscosity of the composition is not limited and may range, for example, from about 10 cps to about 1,000,000 cps. Without intending to be limited, it is believed that the advantages of the present invention will be most fully realized when the cosmetic formulations are pseudoplastic or thixotropic, or otherwise have high viscosities at room temperature (e.g., greater than about 10,000 cps) such that they tend to adhere to the container walls in the absence of shear forces. In one preferred embodiment, the product is in the form of a mascara for application to the eyelashes.

Figure 1:
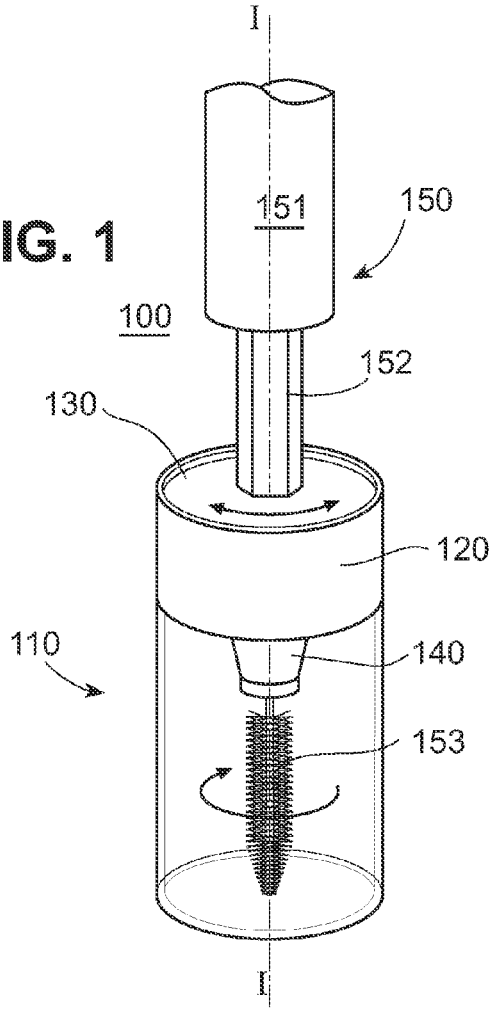
FIG. 1 illustrates an exemplary package for dispensing a material according to the invention. In the illustrated embodiment, a rigid, rotating wiper support 130 has an orifice through its geometric center and is held by a mount 120.

Referring to FIG. 1, an exemplary package 100 according to the invention is illustrated. A container 110 is shown comprising side walls extending from a closed base to an open mouth to define an interior space for holding a charge of liquid or solid (e.g., powder). The container 110 may be made of any suitable material, for example, molded or blow-molded plastic, glass, metal, laminated material, or any combination thereof. Moreover, although the container 110 will typically be a solid structure, it may also be flexible in one or more dimensions.

An applicator 150 comprises a handle 151, which is not strictly necessary to the invention and which may, for example, be in the form of a threaded or snapping cap or any other means for securing to the container (not shown) or be specially adapted with impressions or textured surfaces for gripping with the fingers. The applicator 150 also has a rod 152 extending therefrom to an applicator element 153. The handle and rod may be formed from a unitary piece of material or may be separate members that are connected. Although the rod 152 is shown to have a hexagonal cross-section, the rod 152 may comprise an elliptical cross section (e.g., circular or oval) or non-elliptical cross section (e.g., semi-circular, rectangular, triangular, hexagonal or the like).

The applicator element 153 may be of any material and configuration capable of holding a charge of liquid or solid material and transferring it to the desired surface, such as a human integument, including keratin fibers (hair of the scalp, eyelashes, etc.), nails, lips, skin, or the like. The applicator element 153 may, for instance, take the form of a molded brush, a twisted wire brush, a foam pad, a flocked surface, a staked fiber brush, a comb, a plastic spatula, or any other surface which can hold and deliver the liquid or solid material.

The mouth of the container 110 is in contact with a mount 120, which provides a structural support for the inventive dynamic wiper. In one embodiment, the mount 120 comprises concave side walls defining a cylindrical open space, which connect a first and second open end. Typically, the mount 120 is made from a solid material, such as plastic, rubber, other polymeric materials, metal, and/or glass, and is attached to the container 110 by any conventional means, such as but not limited to a sealant, complementary threading, snaps, or the like. In any event, the mount 120 is attached to the container 110 in such a way as to prevent leaking of the product at the point of attachment.

As discussed in detail below, the mount 120 may hold a wiper support 130, in a manner which allows the wiper support to rotate freely with respect to the mount 120, for example by engaging the peripheral edge of the wiper support in an annular slot formed in 120. The wiper support 130 is then able to prevent the cosmetic product from leaking or spilling out of the container 110.

In one embodiment, the wiper support 130 comprises an orifice 135 (FIG. 1A) through its geometric center such that the applicator 150 may be passed therethrough to access product contained within the container 110. The orifice 135 corresponds to the size and shape of the rod 152 of the applicator 150, such that the applicator element may be inserted into the orifice to the inside of the container 110. Once the applicator 150 is seated within the orifice 135, the wiper support 130, applicator 150, and/or the wiper 140 prevent any product contained within the container 110 from exiting through the orifice.

The wiper support 130 supports a wiper 140 that typically extends into the interior of the container 110. It will be appreciated that the mount 120, wiper support 130, and wiper 140 may be manufactured as a single part or may be produced as individual components. In other words, the wiper 140 may be integral with the wiper support 130 and/or mount 120 or may be a separate component. The rod 152 typically seals the orifice 135, and the wiper and/or wiper support may be said to "float," by which is meant that it is not physically joined to any other components and is free to move with at least one degree of freedom (e.g., rotational, translational, etc.). In such case, an over-cap (not shown) could be implemented to seal the unit. In any case, the wiper and/or wiper support are free to move with at least one degree of freedom.

The wiper 140 may comprise one or more protrusions, edges, teeth, grooves, or the like that engage with the applicator element 153 to promote removal of excess product. When the applicator 150 is removed from the container 110, such as by pulling or the like, the applicator element 153 passes through the wiper 140, and any excess product contained on the applicator element is freed and maintained inside the container 110.

As shown, the wiper support 130 is freely rotatable about a vertical axis extending from the center of the base of the container 110 through the geometric center of the wiper support 130 ("central axis" I-I). Accordingly, when the applicator 150 is seated in the orifice 135 of the wiper support 130, it may be rotated about the central axis I-I, while still preventing the product from exiting the orifice. In this way, the applicator element 153 may be rotated within the container 110 to stir the product contained therein, without allowing the product to splash or spill.

Figure 1A:
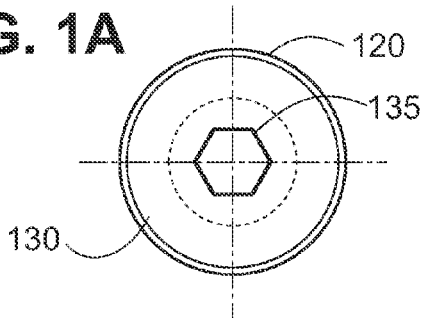
FIG. 1A illustrates a top view of wiper support 130 of FIG. 1 held in place by mount 120 and comprising an orifice 135 through its geometric center.

Importantly, the rotation of the wiper support 130 may occur without spinning the applicator 150 in the orifice (i.e. without slipping between the applicator 150 and the wiper support 130). As shown, the rod 152 of the applicator 150 is non-circular shaped and is received by a complimentary orifice (FIG. 1A at 135). Accordingly, the wiper support 130 and applicator 150 rotate about the central axis I-I together. In an alternative embodiment, the rod 152, wiper support 130 and/or wiper 140 may include a locking mechanism (e.g., a friction fit, keyway or the like), which prevents the rod (whether circular or non-circular) from spinning within the orifice during rotation, but still allows for the applicator 150 to be removed from the container 110 by a user without difficulty.

Referring to FIG. 1A, a top view of an exemplary rotating, rigid wiper support 130 is shown. The illustrated wiper support 130 is rigid and in the form of an annular disk having an orifice 135 through its geometric center. A mount 120 restricts the wiper support 130 by its outer edges, while allowing it to freely rotate about the center axis (not shown).

Figure 2:
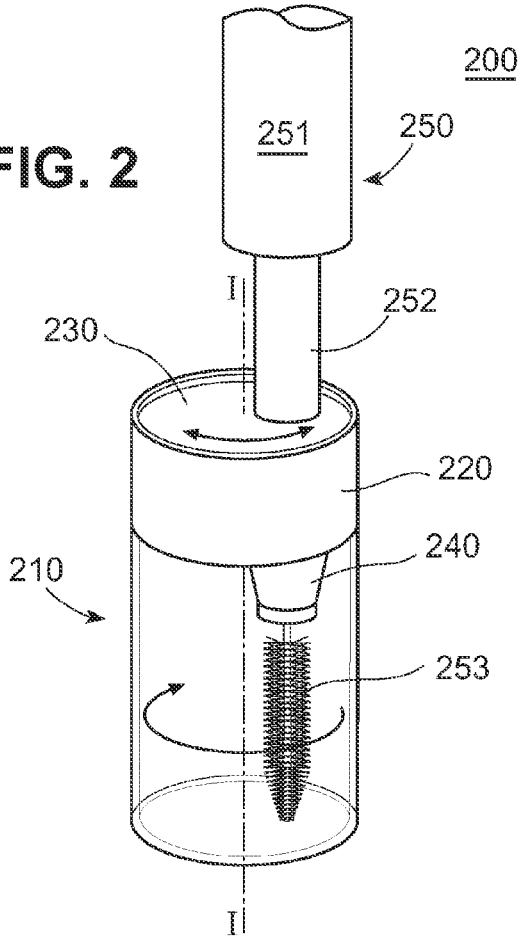
FIG. 2 illustrates an exemplary package for dispensing a material according to the invention comprising a rotating, rigid wiper support having an off-center orifice therethrough, wherein the applicator defines an axis parallel to the central axis I-I such that the applicator moves in a circle around the central axis.

Referring to FIG. 2, an exemplary cosmetic package 200 is shown comprising a container 210 with a mount 220 holding a wiper support 230. The wiper support may be rigid, telescoping, elastic, or otherwise deformable. The wiper support 230 comprises an orifice 235 (FIG. 2A) therethrough, which is located away from its geometric center (i.e., "off-center" or "offset from the center"). As shown, the wiper support 230 and seated applicator 250 are freely rotatable about a central axis I-I of the package 200. However, the off-center location of the orifice 235 allows for the applicator element 253 of the applicator 250 to access more of the product in the container 210, specifically product located on or about the inner side walls of the container.

As discussed above, the rod 252, wiper support 230 and/or wiper 240 may include a locking mechanism, which prevents the rod (whether circular or non-circular) from spinning within the orifice during rotation, but still allows for a user to easily remove the applicator 250 from the container 210.

Figure 2A:
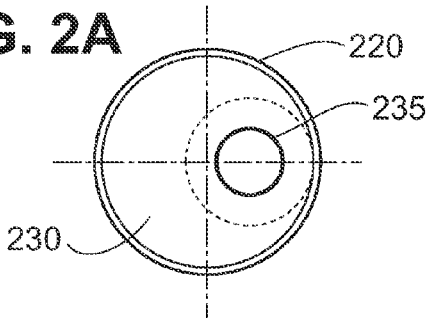
FIG. 2A is a top view of an exemplary, rotating, rigid wiper support 230 held in place by a mount 220 and comprising an orifice 235 located away from its geometric center.

Referring to FIG. 2A, a top view of an exemplary rotatable, rigid wiper support 230 is shown. The wiper support 230 comprises an annular disk having an orifice 235 located away from its geometric center. The orifice 235 may be located as far away from the geometric center as desired, including adjacent to the interior walls of the mount 220 or even overlapping the geometric center. In one embodiment, the location of the orifice is determined based on the geometry of the container.

Referring to FIG. 3, an exemplary package 300 is shown comprising a container 310 with a mount 320 holding a flexible, telescoping rotating wiper support 330. The wiper support 330 allows an applicator 350 seated in wiper 340 to move with the wiper in multiple directions, including without limitation, vertically, horizontally, diagonally, rotationally, and any combination of such movements. The flexible material may be, without limitation, an elastomeric polymer such as synthetic or natural rubber.

In another embodiment, the wiper support 330 may comprise a telescoping surface to allow the wiper support and applicator 350 to move in multiple directions, without slipping. The telescoping surface may comprise, for example, a series of tapered, concentric ring-like or annular members arranged such that they may be extended or retracted to bring their surfaces into tight frictional engagement and thereby form a seal. Of course, the telescoping surface of a wiper support 330 may comprise either a flexible material or a rigid material, depending on the desired range of movement of the applicator element 353 within the container 310.

As shown, the wiper support 330 allows for tilting and/or toggling of the applicator 350 about the central axis I-I, and also allows for the rotational movement of the wiper support and applicator about the central axis I-I. For example, the applicator 350 may be toggled from a first position along a first axis (e.g., the central axis I-I), to a second position along a second axis I'-I'. Preferably, the applicator 350 and wiper support 330 do not experience slipping when tilted or toggled, which causes at least a first portion of the wiper support 330 to raise with respect to the mount 320, while a second portion of the wiper support is lowered with respect to the mount. In any event, the first axis I-I and the second axis I'-I' may both pass through the geometric center if the orifice 335 (FIG. 3C) is centered on a circular wiper support 330.

When the wiper support 330 comprises a flexible material or telescoping surface, the cosmetic package 300 can accommodate both long and short applicators 350. The product in the container 310 may be protected by a seal, preferably a liquid-tight seal, and more preferably an air-tight seal between the applicator 350 and wiper 340, while still being adequately stirred and reached by a shorter applicator. In fact, even with a shorter applicator 350 than is conventional, the invention allows for more of the product to be reached by the applicator element 353. In one embodiment, an air-tight seal may be provided by an over-cap (not shown), which may act to rotate the wiper support 330 and/or wiper 340 when screwed or unscrewed from the container, as described in U.S. patent application Ser. No. 13/279,392, titled "Cosmetic Cap Sealing System," filed contemporaneously herewith on Oct. 24, 2011, incorporated herein by reference in its entirety.

As discussed above, the rod 352, wiper support 330 and/or wiper 340 may include a locking mechanism, which prevents the rod from spinning within the orifice during rotation, but still allows for a user to easily remove the applicator 350 from the container 310.

Referring to FIG. 3A, the package 300 of FIG. 3 is shown with the applicator 350 in a proximal or downward position with respect to the container 310. The flexible surface of the wiper support 330 allows for the distal and/or proximal movement of the applicator 350 such that the applicator element 353 can easily be positioned to collect cosmetic product located near the base or mouth of the container 310.

In one embodiment, the wiper support 330 may have a locking device (not shown), such that the applicator 350 may be locked into place when pressed proximally into the container 310, preventing the inadvertent removal of the applicator from the container. The applicator 350 and the top edge or side walls of the mount 320 may also comprise complimentary fastening means, such as but not limited to complimentary threads or snaps. When the applicator 350 is pressed into the orifice (FIG. 3C at 335) proximally toward the container 310, it may be screwed or snapped into the mount 320 to prevent the applicator from being inadvertently removed therefrom. Of course, the package 300 may comprise a cap that fits over the applicator 350 and attaches to the mount 320 or container 310 to prevent the applicator from being inadvertently removed from the container.

FIG. 3B illustrates three positions (A, A', and B) of a floating wiper 340 supported by a wiper support 330 and disposed within a container (not shown). As the wiper support 330 is toggled, tilted, rotated or pushed/pulled in a distal or proximal direction, the floating wiper 340 is similarly manipulated. For example, the floating wiper 340 may be toggled from a first position A' on a first axis I-I, to a second position B, located on a second axis (not shown). As another example, the floating wiper 340 may be pressed into the container from a first position A', to a second position A, which are both located on the same vertical axis I-I. Of course, the floating wiper may be toggled, tilted, pushed and/or pulled sequentially or simultaneously.

Referring to FIG. 4, an exemplary cosmetic package 400 is shown comprising a container 410 having a mount 420 holding a wiper support 430. The wiper support 430 is shown to comprise an orifice (FIG. 4A at 435), which is located away from the geometric center of the wiper support. An applicator 450 is shown seated within the orifice 435 in such a way as to prevent any cosmetic product in the container 410 from escaping.

The wiper support 430 allows for the applicator 450 to be tilted or toggled from a first position on a first vertical axis to a second position on a second vertical axis I'-I', without slipping from the wiper support. As shown, the wiper support 430 and applicator 450 are also freely rotatable about the central axis I-I in both the first vertical position and second vertical position. The off-center location of the orifice 435 allows for the applicator element 453 of the applicator 450 to access more of the product in the container 410, especially product adhered to the side walls of the container 410.

Figure 5:
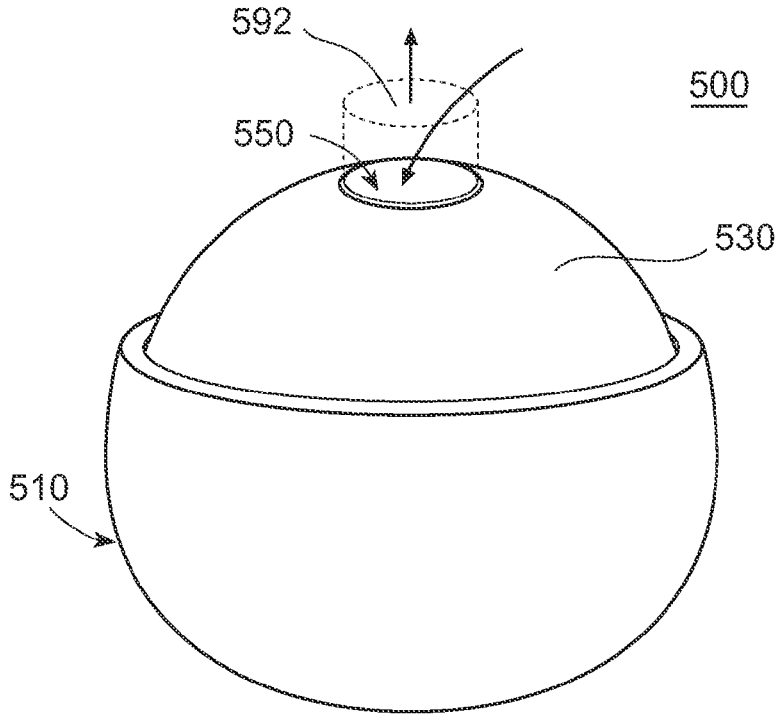
FIG. 5 illustrates an exemplary package for dispensing a material according to the invention comprising a lockable applicator and bowl-shaped container.

Referring to FIG. 5, another exemplary package 500 is shown comprising a container 510 having a wiper support 530 and applicator 550 disposed therein. In one embodiment, the container 510 comprises a hollow, bowl-shape. The wiper support 530 is shaped to be attached to the container 510, such that an attached floating wiper (not shown) is at least partially situated within the interior space of the container. For example, the pictured wiper support 530 is shown to comprise a hollow, bowl-shape having a diameter that is less than that of the container 510.

As shown, an applicator 550 may be placed or stored within the cosmetic package 500 in a locked position. In one embodiment, the wiper support 530 may comprise a locking means (not shown) such that the applicator 550 may be placed in a retracted position within the package 500 when pressed proximally into the container 510. The applicator 550 may then be transitioned to an unlocked or extended position by pressing it again in a proximal direction. As shown, the applicator 550 may initially be in a retracted position, but may be pressed to expose the handle 592, which may be gripped and manipulated by a user, for example, to move the applicator element of the applicator (not shown) within the container 510 or to remove the applicator from the package 500.

Figure 6:
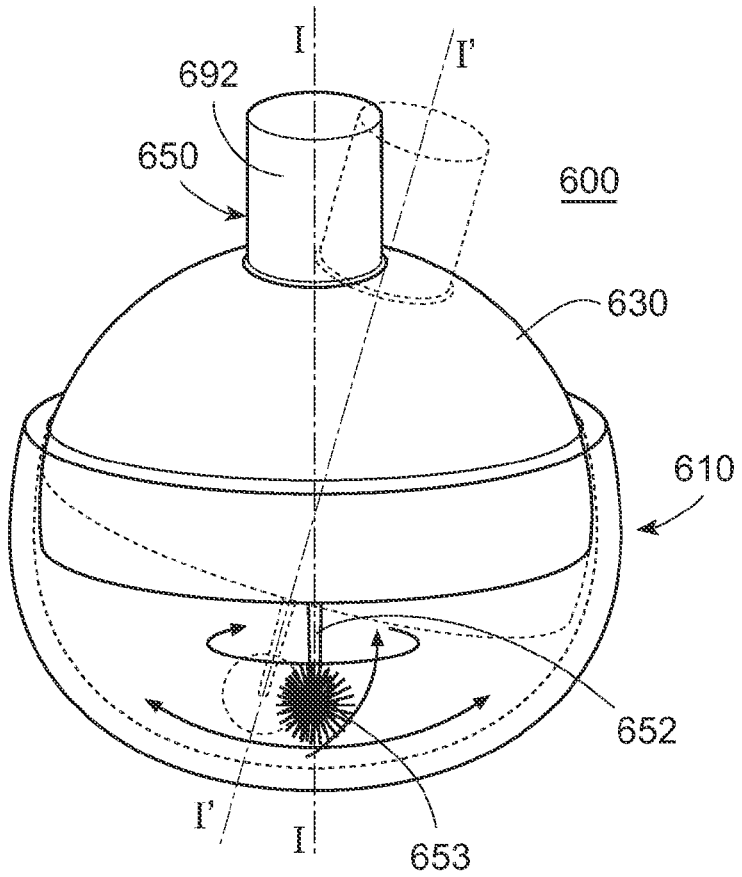
FIG. 6 illustrates an exemplary package of FIG. 5 wherein the applicator is in an unlocked, extended configuration such that the user can grip it with the fingers, the wiper (not shown) and applicator being movable together in three dimensions, including rotation about axis I-I and toggling.

Referring to FIG. 6, an exemplary package 600 is illustrated comprising a wiper support 630 in contact with a container 610, and an applicator 650. The wiper support 630 may be tilted or toggled within the container 610 from a first position along a first vertical axis I-I to a second position on a second vertical axis I'-I'. Moreover, the wiper support 630 may be rotated about either the first vertical axis I-I or second vertical axis I'-I'.

As shown, the applicator 650 is in an extended position such that the handle 692 is accessible to be gripped and manipulated by a user. Because the applicator 650 is partially disposed within the wiper support 630, the user may rotate the support by manipulating the applicator. In this way, the applicator element 653 and rod 652 of the applicator 650, which are disposed in the container 610, may be moved in any number of directions therein to access product at nearly any location within the container.

Although not shown, the wiper support 630 is in contact with a wiper. The applicator 650 may be disposed through an orifice in the wiper such that excess product is removed from the applicator element 653 upon removal of the applicator from the container 610.

Figure 7:
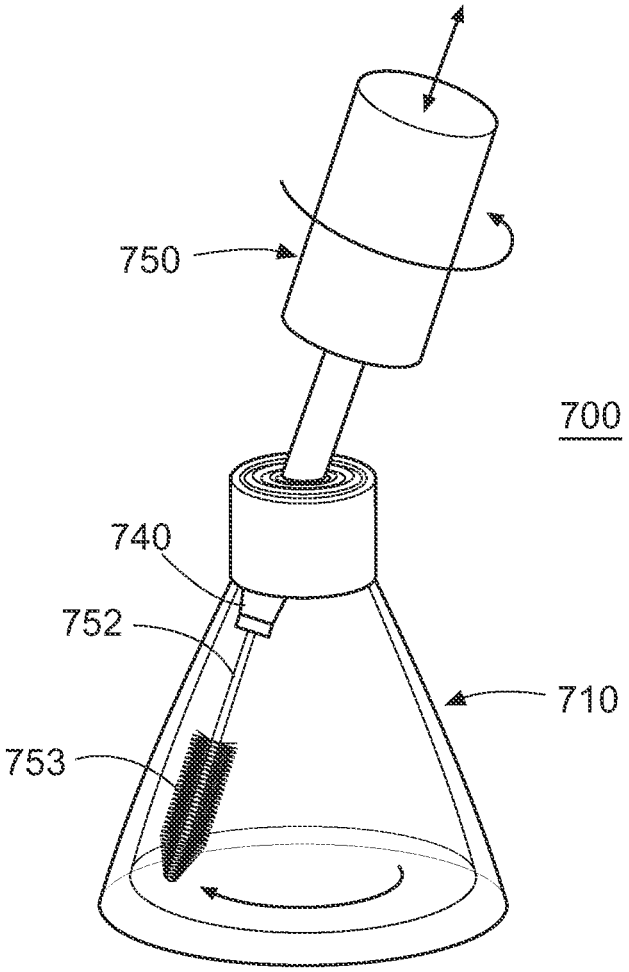
FIG. 7 illustrates an exemplary package for dispensing a material according to the invention comprising a Erlenmeyer flask-shaped container having a wider base than top.

Referring to FIG. 7, an exemplary cosmetic package 700 according to one embodiment is shown comprising a container 710. The container 710 comprises a base from which sloped side walls extend to form a mouth having a substantially smaller diameter than the base. A typical non-dynamic wiper would not allow for the applicator element to reach product located in areas where the side walls meet the base due to the large distances between these areas and the mouth of the container 710. Therefore, a large amount of product would be wasted.

However, the dynamic wipers of the invention allow for a greater range of movement of the applicator 750 within the interior of the container 710. In particular, the dynamic wipers, when engaged with the applicator 750, permit the applicator element 753 of the applicator to be moved within the interior of the container 710 with greater range than previously attainable, including to areas where the side walls meet the base.

Figure 8:
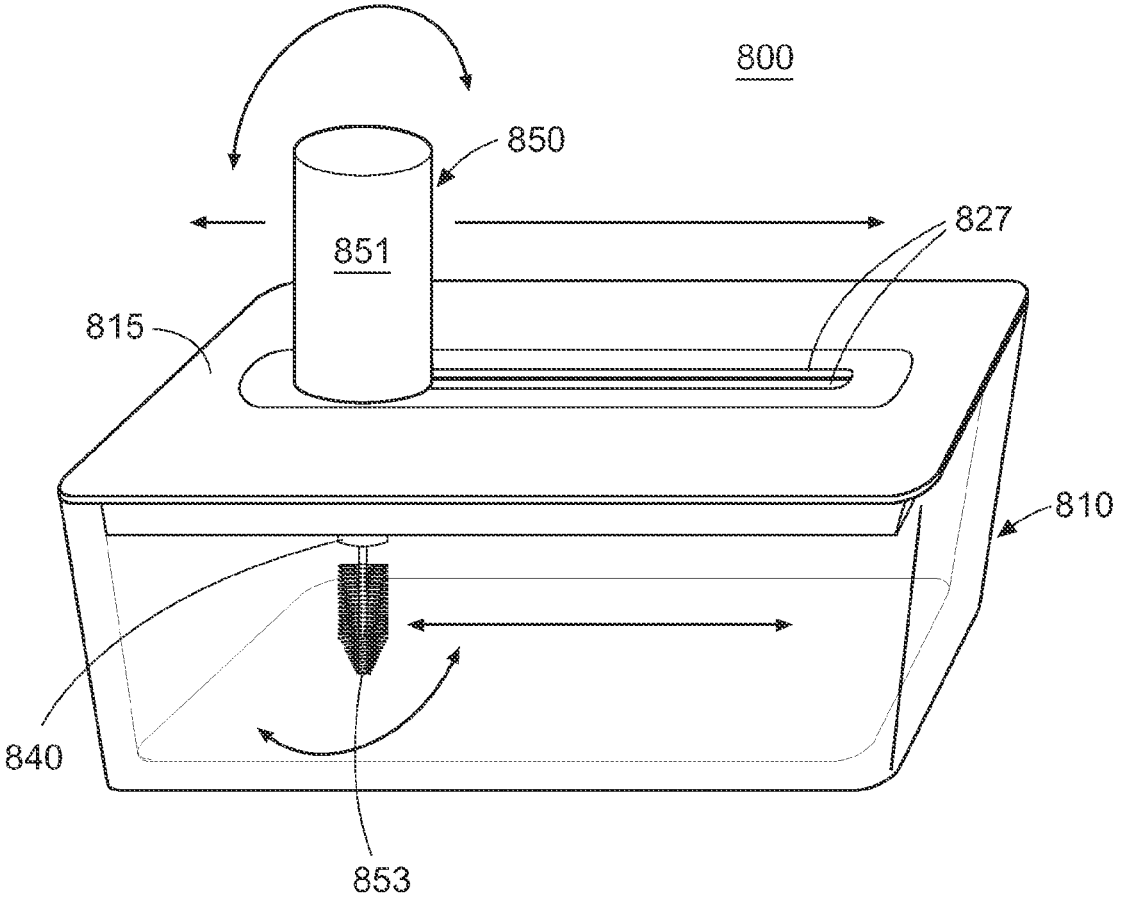
FIG. 8 illustrates an exemplary package for dispensing a material according to the invention comprising a horizontally slideable wiper and resealable membrane.

Referring to FIG. 8, an exemplary cosmetic package 800 is shown comprising a track along which an applicator 850 and wiper 840 may be slid from a first position to a second position. Although the track is shown as being linear, it may be any linear or non-linear pattern (e.g., a curve, semi-circle, or wave pattern) that is fully contained within the container cover 815. As shown, the cosmetic package 800 comprises a generally rectangular shaped container 810 although any number of shapes are possible. As illustrated, the container has four side walls extending from a base to an open mouth, which is sealed by a container cover 815. The container cover 815 has an elongated opening through which the applicator 850 is slideably moveable from one end of the container to the other. A sealing mechanism, shown as opposed flexible flaps 827, closes the elongated opening. A wiper 840 is attached to a support (not shown) which may be formed on the underside of cover 815 inside of the container 810 so as to allow an applicator 850 to be inserted through the orifice. As shown, the applicator comprises a handle 851, which may be moved across the elongated opening by a user, unsealing the opposed flaps 827 in the immediate areas of the applicator. It will be appreciated that the floating wiper 840 will move horizontally across the container cover 815 with the applicator 850. The handle 851 may also be toggled or tilted by the user such that the applicator element 853 is moved toward a side wall of the container 810.

In one embodiment, the sealing mechanism 827 comprises interlocking teeth or protrusions that open when contacted by an applicator 850 passing horizontally across the track. The interlocking teeth or protrusions may close behind the applicator 850, upon passing. In another embodiment, the sealing mechanism 827 comprises two or more pieces of an elastomeric material, which press against each other to form a seal. Upon encountering the applicator 850, the two or more pieces of elastomeric material may be forced apart to allow passage. However, once the applicator 850 passes, the pieces return to their original position to seal the container cover 815.

Figure 9:
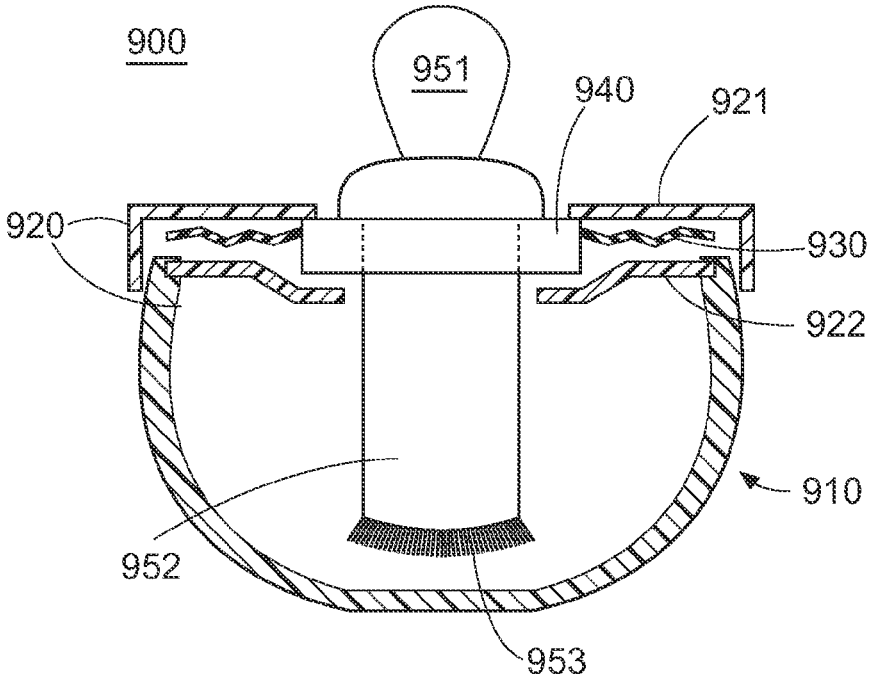
FIG. 9 is a cross-sectional view of an exemplary package for dispensing a material according to the invention, illustrating the use of top and bottom mechanical stops to limit travel of the membranes during use.

Referring to FIG. 9, a cross-sectional view of an exemplary cosmetic package 900 according to the invention is illustrated. The package 900 comprises a bowl-shaped container 910 having a mount 920 attached to the open mouth thereof. The mount 920 is shown to comprise a rigid upper mechanical stop 921 and a rigid lower mechanical stop 922, which may either be two separate components or may be a single component. Both a wiper 940 and wiper support 930 are positioned between the upper mechanical stop 921 and lower mechanical stop 922 of the mount 920 to allow for fixed vertical movement. The wiper 940 is also positioned within the wiper support 930, which allows the wiper to move horizontally across the mouth of the container, and also allows for the wiper to rotate about a vertical axis. In other embodiments, the mount 920 may comprise a rigid side rim (not shown) such that horizontal movement of the wiper 940 is substantially prevented. Moreover, although the wiper 940 is shown on the same horizontal plane as the wiper support 930, it will be appreciated that the wiper may alternatively be located above or below the wiper support.

The wiper support 930 is shown to comprise a flexible and/or telescoping material. The wiper support 930 is typically attached to the mount 920, although it may be attached to the container 910 instead, or both the container and the mount. The wiper support 930 allows the wiper 940 to move a fixed distance in the downward direction when pushed toward the container, yet returns the wiper to the initial vertical position when the downward force is removed. The vertical movement of the wiper support 930 is limited in the downward vertical direction by the lower rim 922 of the mount 920.

As shown, the wiper 940 has an applicator disposed in an orifice thereof. The rod 952 of the applicator extends through the mount 920, wiper support 930, and wiper 940 so that the applicator element 953 reaches the product within the container 910. When the applicator is removed from the container 910, such as by pulling of the handle 951 or the like, the applicator element 953 passes through the wiper 940, and any excess product contained on the applicator element is freed and maintained inside the container 910.

Figure 10:
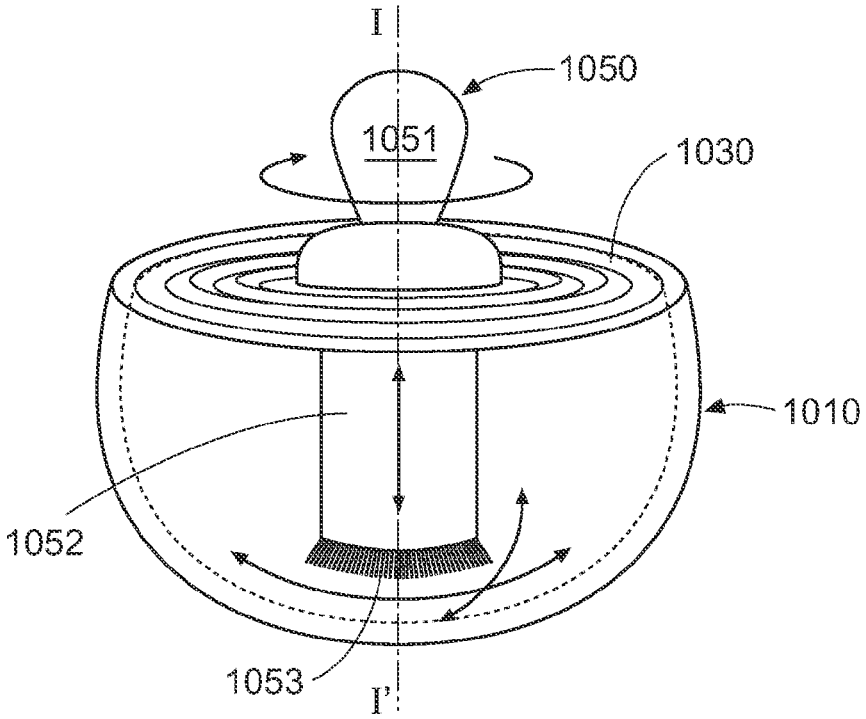
FIG. 10 is a cut-away view of an exemplary package for dispensing a material according to the invention.

Referring to FIG. 10, a cut-away illustration of an exemplary cosmetic package is shown comprising an applicator 1050 partially disposed within a bowl-shaped container 1010. A wiper support 1030 having a telescoping surface is shown, which allows for the distal and proximal movement of the applicator 1050 with respect to the container 1010 such that the applicator element 1053 may easily be positioned to collect liquid or powdered product located near the base or mouth of the container. The applicator 1050, wiper support 1030, and wiper (not shown), may be rotated about a vertical axis I-I, tilted or toggled about the axis, pushed or pulled along the axis, and/or any combination of these movements. Accordingly, the applicator element 1053 of the applicator may be moved within the interior of the container 1010 with greater range than previously attainable.

Although the dynamic wipers of the invention are generally described herein in relation to "cosmetics," the invention is not so limited and may be employed in any field where an applicator is employed to distribute a liquid or solid (e.g., powdered) material. For example, the invention may be particularly useful in paint and/or adhesive applications. Accordingly, the containers may comprise any shape suitable for such uses, such as paint buckets or the like, and the applicators may comprise any shape suitable for such uses, such as paint brushes or paint rollers.

The invention having been described by the forgoing description of the preferred embodiment, it will be understood that the skilled artisan may make modifications and variations of these embodiments without departing from the spirit or scope of the invention as set forth in the following claims.

All patent and non-patent literature discussed above is hereby incorporated by reference in its entirety for all purposes.

We claim:

1. A package for a composition, the package comprising:

(i) a container for holding said composition;

(ii) an applicator for removing a portion of said composition from said container and transferring it to a surface, the applicator comprising a handle for gripping on one end thereof and an applicator element for holding a charge of said composition on the other end thereof; and (iii) a wiper having an orifice forming a passage between the exterior and interior of said container, wherein said applicator is disposed through said wiper orifice such that a portion of the applicator is brought into contact with said composition and engages with the wiper such that the applicator and wiper together are tiltable about an axis defined by said applicator and wherein said applicator and wiper together are further capable of one or more movements selected from the group consisting of: sliding across a horizontal axis, rotating about an axis defined by said applicator, moving in a circle about a central axis of said container, and moving along an axis defined by said applicator toward and away from the interior of said container; said wiper being configured to remove excess composition from said applicator element when the applicator element is drawn through said wiper orifice upon removing the applicator from the container.

2. A package according to claim 1, wherein said applicator and wiper together are capable of rotating about an axis defined by said applicator.

3. A package according to claim 1, wherein said applicator and wiper together are capable of moving along an axis defined by said applicator toward and away from the interior of said container.

4. A package according to claim 1, wherein said wiper is supported by a telescoping or flexible support.

5. A package according to claim 1, further comprising a liquid disposed inside said container.

6. A package according to claim 5, wherein said liquid is pseudoplastic.

7. A package according to claim 5, wherein said liquid is mascara.

8. A package according to claim 7, wherein said mascara is pseudoplastic.

9. A package according to claim 1, further comprising a powdered solid disposed inside said container.

10. A package according to claim 9, wherein said powdered solid is an eye shadow.

11. A package according to claim 1, wherein the applicator and wiper orifice have complementary cross-sectional shapes.

12. A package according to claim 11, wherein the applicator has a non-elliptical cross-section and the wiper orifice has a complementary non-elliptical cross-section.

* * * * *